US009238988B2

(12) United States Patent
Spooner et al.

(10) Patent No.: US 9,238,988 B2
(45) Date of Patent: Jan. 19, 2016

(54) CYLINDER HEAD MOUNT

(75) Inventors: Alan Geoffrey Spooner, Aylesbury Buckinghamshire (GB); Daniel James Chidley, Woking (GB)

(73) Assignee: Perkins Engines Company Limited, Peterborough (GB)

( * ) Notice: Subject to any disclaimer, the term of this patent is extended or adjusted under 35 U.S.C. 154(b) by 227 days.

(21) Appl. No.: 13/989,436

(22) PCT Filed: Dec. 13, 2011

(86) PCT No.: PCT/EP2011/072564

§ 371 (c)(1), (2), (4) Date: May 13, 2014

(87) PCT Pub. No.: WO2012/080219

PCT Pub. Date: Jun. 21, 2012

(65) Prior Publication Data

US 2015/0013316 A1 Jan. 15, 2015

(30) Foreign Application Priority Data

Dec. 13, 2010 (EP) ..... 10194674

(51) Int. Cl.

| | |
|---|---|
| ***F01N 1/00*** | (2006.01) |
| ***F01N 13/00*** | (2010.01) |
| *F02F 7/00* | (2006.01) |

(52) U.S. Cl.

CPC ..... *F01N 13/00* (2013.01); *F02F 7/0082* (2013.01); *F02F 7/0021* (2013.01)

(58) Field of Classification Search

CPC ..... F02F 7/0082; F02F 7/0021; F01N 13/00

USPC ..... 60/324

See application file for complete search history.

(56) References Cited

U.S. PATENT DOCUMENTS

| | | | | |
|---|---|---|---|---|
| 4,258,687 | A | 3/1981 | Mauch et al. | |
| 4,267,812 | A | 5/1981 | Aula et al. | |
| 6,089,199 | A | 7/2000 | Lohr et al. | |
| 6,106,344 | A * | 8/2000 | Mashiko | 440/89 R |
| 6,213,074 | B1 | 4/2001 | Freese | |
| 6,983,728 | B1 | 1/2006 | Banks, Jr. et al. | |
| 7,059,291 | B2 | 6/2006 | Ueno et al. | |
| 7,185,642 | B1 | 3/2007 | Redon et al. | |
| 7,237,541 | B2 | 7/2007 | Vanderveen et al. | |
| 7,669,407 | B2 | 3/2010 | Winsor | |
| 7,717,205 | B2 | 5/2010 | Kertz et al. | |

(Continued)

FOREIGN PATENT DOCUMENTS

| | | |
|---|---|---|
| DE | 196 36 820 A1 | 3/1998 |
| EP | 1 035 319 A2 | 9/2000 |

OTHER PUBLICATIONS

English-language International Search Report from European Patent Office for International Application No. PCT/EP2011/072564, mailed Jun. 11, 2012.

(Continued)

*Primary Examiner* — Jesse Bogue
*Assistant Examiner* — Diem Tran

(57) ABSTRACT

A cylinder head mount comprising a base portion for mounting to a cylinder head of an engine; a bracket portion configured to receive and support an engine component; and a body portion interposed between the base portion and the bracket portion.

15 Claims, 3 Drawing Sheets

(56) References Cited

U.S. PATENT DOCUMENTS

| | | | | |
|---|---|---|---|---|
| 8,904,766 | B2 * | 12/2014 | Saito et al. | 60/299 |
| 2008/0223329 | A1 | 9/2008 | Preimesberger et al. | |
| 2009/0241879 | A1 | 10/2009 | Harbert | |
| 2010/0031644 | A1 | 2/2010 | Keane et al. | |
| 2010/0170482 | A1 | 7/2010 | Feist et al. | |

OTHER PUBLICATIONS

English-language European Search Report from Munich Patent Office for EP 10 19 4674, date of completion of search Jun. 17, 2011.

* cited by examiner

CYLINDER HEAD MOUNT

TECHNICAL FIELD

This disclosure generally relates to the field of internal combustion engines, particularly to mounting of engine components within an engine enclosure, and more particularly to structures which support the engine components to the engine.

BACKGROUND

Support structures may be used to mount engine components onto an engine enclosure or even to support the component remotely from the engine. The components that may be typically mounted include aftertreatment devices, mufflers, turbochargers, Exhaust Gas Recirculation (EGR) coolers, oil coolers, electronic control modules (ECM) and oil filters.

Various exhaust treatment components may be mounted individually in an exhaust system within the available space using individual support structures. However, due to the increasing complexity and number of exhaust treatment components and the small amount of available space, mounting and interconnecting exhaust treatment components may be difficult.

Nevertheless, there remains a need for the incorporation of exhaust treatment components within the limited available space, without requiring substantial and costly redesign of the machine. These space constraints may be further exacerbated by other requirements, such as maintaining heat rejection levels from an engine or other components at satisfactory levels.

U.S. Pat. No. 7,717,205, in the name of Caterpillar Inc., discloses a hood assembly for a machine which may have an enclosure to which at least one exhaust aftertreatment device is integrated. The exhaust aftertreatment system may be mated to an exhaust pipe from the engine. The engine hood assembly may include ventilation openings to assist in heat rejection from the engine compartment and from the exhaust aftertreatment devices. However, the exhaust aftertreatment device may be mounted in a exhaust hood assembly that may obstruct the view from the cab of the machine.

Support structures may be used to mount engine components onto a base engine structure. However, vibrations generated by the engine during operation may negatively affect components that are connected thereto. Generally, the support structures that may be used to mount the components may be designed to reduce or obviate excessive vibrations being transferred from an engine to a mounted engine component.

These support structures may be designed to be sufficiently rigid to obviate transfer of vibrations from the operating engine to a mounted engine component. However, such support structures may often be relatively larger and heavier than what is required to maintain component mounting in a static condition. Large and heavy support structures may also result in an increase in production cost of an engine and a decrease in fuel economy of the engine due to their larger size and weight.

US 2008/0223329 A1 discloses a compound bracket system for an internal combustion engine having a first bracket that may be rigidly connected to a crankcase of the internal combustion engine and a second bracket that may be connected to the crankcase through an intake manifold. The first bracket may form at least one mounting pad that is arranged to connect to and support a turbine. The second bracket may form a component cavity that is arranged to accept and support an EGR cooler. The first bracket may have an interconnection pad, and the second component may have a strut with a mounting tab that may be connected to the interconnection pad to increase the rigidity of the second bracket.

The present disclosure is directed, at least in part, to improving or overcoming one or more aspects of the prior art engine component support structures.

BRIEF SUMMARY OF THE INVENTION

In a first aspect, the present disclosure describes a cylinder head mount comprising a base portion for mounting to a cylinder head of an engine; a bracket portion configured to receive and support an engine component; and a body portion interposed between the base portion and the bracket portion.

Other features and advantages of the present disclosure will be apparent from the following description of various embodiments, when read together with the accompanying drawings.

BRIEF DESCRIPTION OF THE DRAWINGS

The foregoing and other features and advantages of the present disclosure will be more fully understood from the following description of various embodiments, when read together with the accompanying drawings, in which.

DETAILED DESCRIPTION

This disclosure generally relates to mounting structures used to mount an engine component onto an engine.

Figure 1:
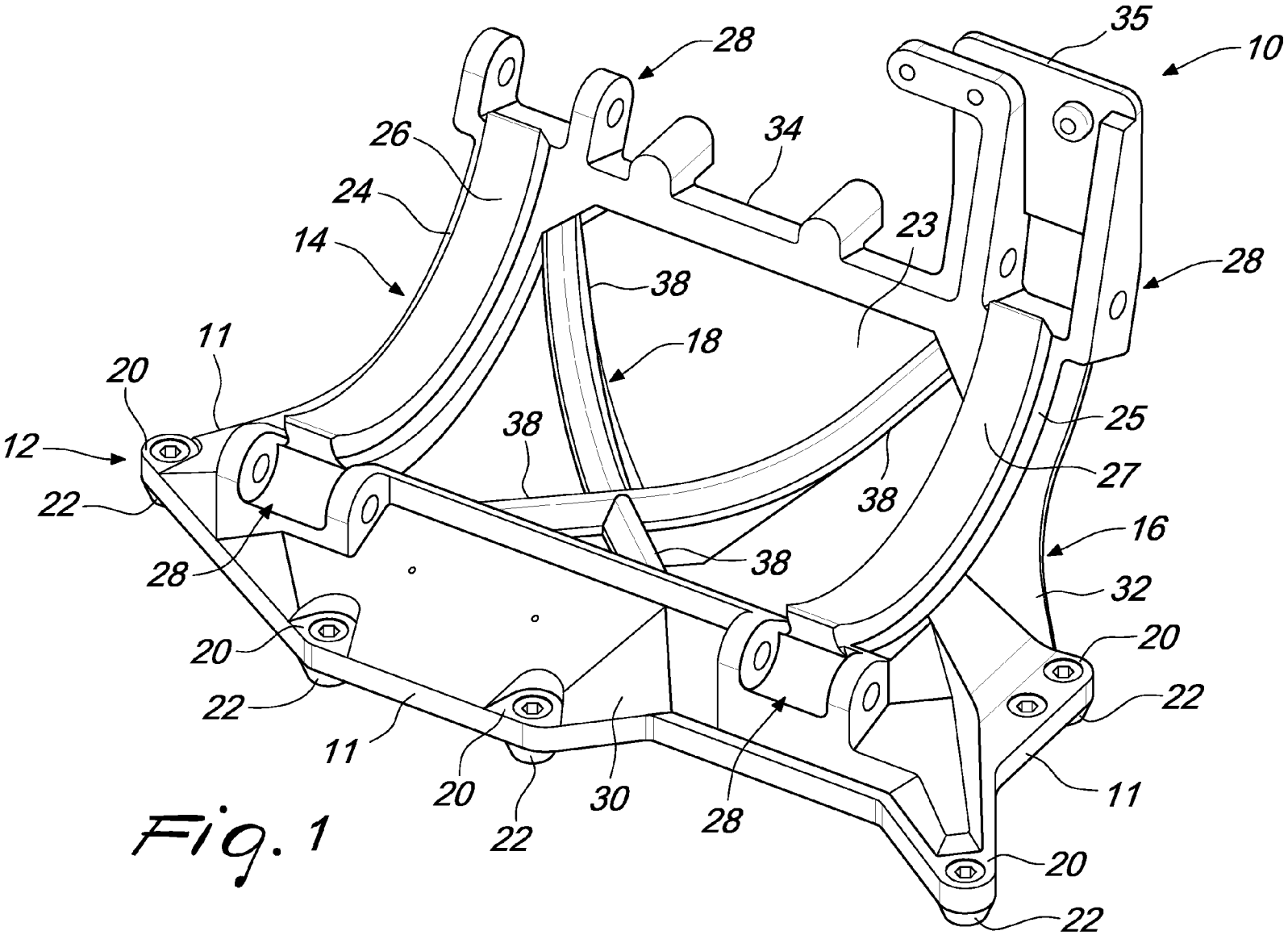
FIG. 1 is an isometric view of a cylinder head mount according to an embodiment of the present disclosure.

FIG. 1 illustrates a cylinder head mount 10 for receiving and supporting an engine component, such as an exhaust aftertreatment device, a muffler or an air filter. The cylinder head mount 10 may comprise a base portion 12, a bracket portion 14 and a body portion 16. The body portion 16 may connect the base portion 12 to the bracket portion 14. The cylinder head mount 10 may further comprise a web support 18.

The base portion 12 may provide for connection of the cylinder head mount 10 to the engine. The base portion 12 may be substantially c-shaped with a longitudinal axis and having an outer perimeter edge 11 and an inner perimeter edge 13. The perimeter of the base portion 12 may be delineated by the outer perimeter edge 11 and inner perimeter edge 13.

The outer perimeter edge 11 may define the outermost edge of the cylinder head mount 10. The geometry of base portion 12 may be configured with respect to the geometry of the cylinder head of the engine.

The area of the base portion 12 between the outer perimeter edge 11 and the inner perimeter edge 13 may be a function of one or more of the following: mounting points between the cylinder head mount 10 and the engine, height of the cylinder head mount 10, weight and volume of the engine component, structural characteristics of the cylinder head mount 10 and positioning of other external components such as hoses, pipes, electrical wires and connections.

The base portion 12 may connect the cylinder head mount 10 to an engine through base flanges 20. Each base flange 20 may include through holes to enable mounting of the cylinder head mount 10. The base flanges 20 may be arranged adjacent the outer perimeter edge 11 of the base portion 12. The base flanges 20 may be positioned at the base portion 12 to correspond to the positions of the bolt holes in the cylinder head. The base flanges 20 may be aligned to the corresponding bolt holes in the engine at a mounting position of the cylinder head mount 10.

The number and distribution of the base flanges 20 may provide for stable mounting of the cylinder head mount 10. The outer perimeter edge 11 of the base portion 12 may be configured with respect to number and distribution of the base flanges 20. The geometry of the outer perimeter edge 11 may be related to the number and distribution of the base flanges 20.

The number of the base flanges 20 at the base portion 12 may be a function of one or more of the following: mounting points between the cylinder head mount 10 and the engine, height of the cylinder head mount 10, weight and volume of the engine component, structural characteristics of the cylinder head mount 10 and structural characteristics of a cylinder head.

The base portion 12 may be provided with between 5 to 10 base flanges 20. In an embodiment, the base portion may be provided with at least 5 base flanges 20.

The distribution of the base flanges 20 at the base portion 12 may be a function of one or more of the following: mounting points between the cylinder head mount 10 and the engine, height of the cylinder head mount 10, weight and volume of the engine component, structural characteristics of the cylinder head mount 10 and structural characteristics of a cylinder head. In an embodiment a rigid mounting area may require lesser mounting points than a less rigid area.

A hollow base finger 22 may be provided at each base flange 20. The base fingers 22 may be integrally formed with the base flange 20. The base fingers 22 may have a longitudinal axis that is substantially perpendicular to the longitudinal axis of the base portion 12 and may be orientated to extend in a direction substantially away from the body portion 16. The bore of each base finger 22 may correspond to the through hole in each base flange 20 to form a mutual continuos passage through the base flange 20 and the base finger 22. The base fingers 22 may contact the engine at a mounting position of the cylinder head mount 10.

The bracket portion 14 may be configured to receive and to support the engine component. The bracket portion 14 may have a first support member 24 and a second support member 25. First support member 24 and second support member 25 may be rigidly formed.

First support member 24 and second support member 25 may be formed as separate bands with central axes arranged substantially transverse to the longitudinal axis of the base portion 12. Ends of first and second support member 24, 25 may be positioned within the outer perimeter edge 11 of the base portion 12 and the opposite ends of the first and second support member 24, 25 may be positioned beyond the inner perimeter edge 13. First support member 24 and second support member 25 may delimit opposite ends of an opening 23.

The first and second support members 24, 25 may respectively include a first support surface 26 and a second support surface 27. First support surface 26 and second support surface 27 may be formed as raised bands on the first and second support members 24, 25. The first and second support surfaces 26, 27 may be adapted to support each end of an engine component such as an exhaust aftertreatment device.

The geometry of the first support member 24 and the second support member 25 may be shaped to match an outer geometry of an engine component. For example, when the engine component is an exhaust aftertreatment device that is shaped as a canister, first support member 24 and the second support member 25 may have generally arcuate shapes with substantially the same radii of curvature as the exhaust aftertreatment device. The first and second support surfaces 26, 27 may be adapted to have a geometry complementary to the first and second support members 24, 25 respectively.

In an embodiment, the first and second support members 24, 25 may be formed as a single continuous structure with first and second support surfaces 26, 27 being disposed thereon at opposite ends. The unitary structure of first and second support members 24, 25 may be perforated to permit air flow through the structure.

The body portion 16 may be positioned between the base portion 12 and bracket portion 14. The body portion 16 may be contiguous with the base portion 12 and bracket portion 14. The body portion 16 may be rigidly formed to provide structural support to the bracket portion 14.

The body portion 16 may have a geometry that substantially corresponds to the geometry of the base portion 12. The body portion 16 may have a side wall 30 and wings 32.

The longitudinal axis of the side wall 30 may be parallel to the longitudinal axis of the base portion 12. The width of the side wall 30 may progressively change from the base portion 12 to the bracket portion 14. The body portion 16 may have a greatest width adjacent the base portion 12 and may have a progressively decreasing width towards the bracket portion 14.

The wings 32 may be transverse to the longitudinal axis of the base portion 12 and may sweep inwardly from the outer perimeter edge 11 of the base portion 12 to the bracket portion 14. The wings 32 may respectively join the bracket portion 14 at the sides of the first and second support members 24, 25 that are opposite first and second support surfaces 26, 27.

The body portion 16 may have a rib 34 that connects ends of wings 32 that are opposite the ends of wings 32 joined to the side wall 30. First and second support members 24, 25 of the bracket portion 14 may have ends joined to the body portion 16 at the side wall 30 and opposite ends joined to the body portion 16 adjacent the rib 34.

Body portion 16 may comprise fastener connections 28. The fastener connections 28 may include a pair of retaining members and may allow for hinged connections with straps for fastening an engine component. The fastener connections 28 may be positioned adjacent the ends of the first and second support members 24, 25. The fastener connections 28 may be positioned on the side wall 30 and the rib 34.

The fastener connection 28 may have a bolting plate 35. The bolting plate 35 may be connected to extension of the fastener connection 28 positioned on the rib 34 adjacent second support member 25. The bolting plate 35, or part thereof, may extend to directly join to the rib 34.

Web support 18 may serve to strengthen the cylinder head mount 10. The web support 18 may serve to reduce vibrations in the cylinder head mount 10.

Figure 2:
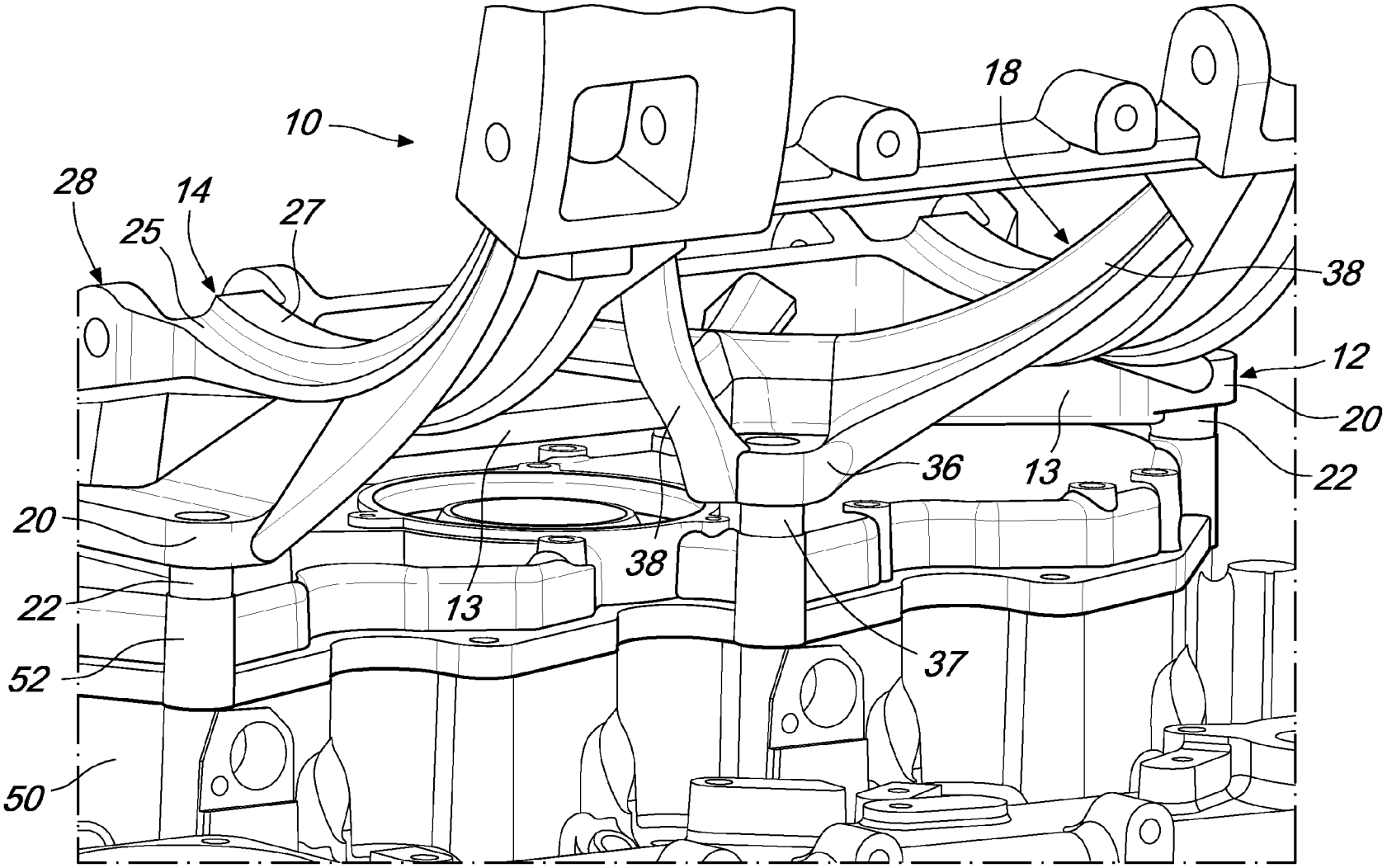
FIG. 2 is an isometric view of the cylinder head mount of FIG. 1 mounted to a cylinder head of an engine according to an embodiment of the present disclosure.

The web support 18 may connect a web flange 36 to the body portion 16 as illustrated in FIG. 2. The web support 18 may connect the cylinder head mount 10 to an engine through web flange 36. The web flange 36 may include a through hole to enable mounting of the cylinder head mount 10. The web flange 36 may be arranged opposite the inner perimeter edge 13 of the base portion 12. The web flange 36 may be positioned on the web support 18 to correspondence to a position of a bolt hole in a cylinder head 50. The web flange 36 may be aligned to the corresponding bolt hole in the engine at a mounting position of the cylinder head mount 10.

The position of the web flange 36 on the web support 18 relative the base portion 12 may be a function of one or more of the following: mounting points between the cylinder head mount 10 and the engine, height of the cylinder head mount 10, weight and volume of the engine component, structural characteristics of the cylinder head mount 10 and structural characteristics of the cylinder head.

A hollow web finger 37 may be provided at web flange 36. The web finger 37 may be integrally formed with the web flange 36. The web finger 37 may have a longitudinal axis that is substantially perpendicular to the longitudinal axis of the base portion 12 and may be orientated to extend in a direction substantially away from the body portion 16. The bore of the web finger 37 may correspond to the through hole in web flange 36 to form a mutual continuos passage through the web flange 36 and the web finger 37. The web finger 37 may contact the engine at a mounting position of the cylinder head mount 10.

The web support 18 may have web arms 38 extending radially from the web flange 36 to the body portion 16.

The web support 18 may have four web arms 38 divergent mutually from web flange 36 and being angularly spaced at substantially 90°. A pair of the web arms 38 may connect the web flange 36 to the wings 32 of body portion 16. One web arm 38 may intersect a first wing 32 at a connection region of first support member 24 and an end rib 34. A further web arm 38 may intersect the second wing 32 at a connection region of second support member 25 and the opposite end of rib 34. The other pair of the web arms 38 may connect the web flange 36 to the side wall 30 of body portion 16 at the side corresponding to inner perimeter edge 13 of base portion 12.

In an embodiment, the web support 18 may connect the web flange 36 through the web arms 38 to the base portion 12, bracket portion 14 and/or body portion 16 or any combination thereof.

In an embodiment, the web support 18 may connect a plurality of web flanges 36 to body portion 16. Each web flange 36 may be provided with a hollow web finger 37.

The number and distribution of the web flanges 36 on the web support 18 may be a function of one or more of the following: mounting points between the cylinder head mount 10 and the engine, height of the cylinder head mount 10, weight and volume of the engine component, structural characteristics of the cylinder head mount 10 and structural characteristics of the cylinder head.

The cylinder head mount 10 may be made of rigid material such as steel.

FIG. 2 further illustrates the cylinder head mount 10 mounted to the cylinder head 50 of an engine. In an embodiment, the base fingers 22 and web finger 37 may contact the cylinder head 50 at a mounting position of the cylinder head mount 10.

The cylinder head mount 10 may be mounted to the cylinder head 50 through a valve cover 52. The valve cover 52 may have bolt holes corresponding to the bolt holes in the cylinder head 50 and may be mounted to the cylinder head 50 at aligned bolt holes of the cylinder head 50 and the valve cover 52.

Positions of the base fingers 22 and web finger 37 on the cylinder mount head 10 may correspond to the positions of the bolt holes of the valve cover 52. The base fingers 22 and web finger 37 may contact the valve cover 52 at a mounting position of the cylinder head mount 10.

The bore of each base finger 22 and the bore of the web finger 37 may superpose the respective bolt holes of cylinder head 50 at the mounting position thereof. The bore of each base finger 22 and the respective aligned bolt holes of the cylinder head 50 and the valve cover 52 may form mutual continuos passages. The bore of the web finger 37 and the respective aligned bolt hole of the cylinder head 50 and the valve cover 52 may form a mutual continuos passage.

The cylinder head mount 10 may be mounted to the cylinder head 50 and the valve cover 52 by threaded screws that pass through the cylinder head mount 10 and valve cover 52 to the cylinder head 50.

Figure 3:
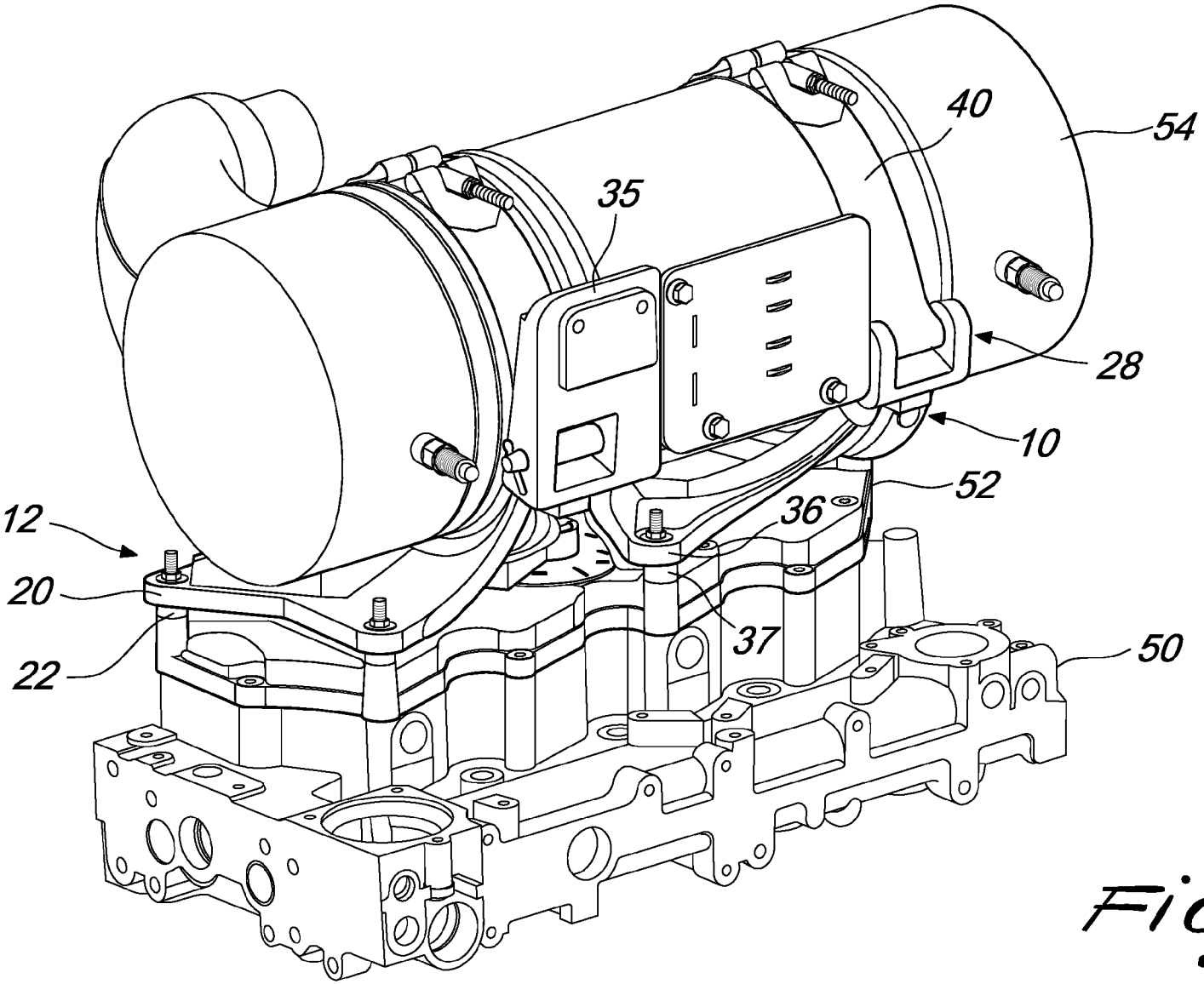
FIG. 3 is an isometric view of a mounted cylinder head mount of FIG. 2 including an aftertreament device according to an embodiment of the present disclosure.

FIG. 3 illustrates an engine component, such as an aftertreatment device 54 assembled onto the mounted cylinder head mount 10. The aftertreatment device 54 may contact and rest on the first support surface 26 and the second support surface 27 of the respective first and second support members 24, 25.

The aftertreatment device 54 may be held on the cylinder head mount 10 by one or more fastener straps 40. The fastener straps 40 may pass over the aftertreatment device 54 to secure the device to cylinder head mount 10.

The aftertreatment device 54 may be held on the cylinder head mount 10 by bolting the device to the cylinder head mount 10 at the bolting plate 35.

The skilled person would realise that foregoing embodiments may be modified to obtain the cylinder head mount 10 of the present disclosure.

INDUSTRIAL APPLICABILITY

This disclosure describes a cylinder head mount 10 for receiving and supporting an engine component.

The industrial applicability of the cylinder head mount 10 as described herein will have been readily appreciated from the following discussion.

The cylinder head mount 10 may allow for the integration of an engine component, such as an aftertreatment device, into the hood of a tractor machine, such as an agricultural tractor, or other machines, such as a genset machine or a industrial open power unit (IOPU). The cylinder head mount 10 may support the engine component such that it is completely enclosed within the engine enclosure of the machine. Installation and servicing of the engine components may be accessible through panels provided in the engine enclosures.

The cylinder head mount 10 may allow for efficient mounting and dismounting of the engine component for servicing thereof. The cylinder head mount 10 itself may be quickly and effectively mounted and dismounted from the cylinder head 50 of an engine.

The cylinder head mount 10 may effectively exploit available space within the engine enclosure and may allow for a reduction in overall size of an engine enclosure. A reduction in the overall size of an engine enclosure may provide for a more streamlined engine enclosure. In an agricultural tractor an engine enclosure that has a reduced profile may enable an operator to have an improved forward view over the engine enclosure. In a machine, such as a genset or an IOPU, a smaller enclosure may allow for reduced storage area or an area occupied by the machine.

The cylinder head mount 10 may enable a corresponding weight reduction of the engine enclosure.

The cylinder head mount 10 may allow for the incorporation of the engine component without undermining air flow and heat rejection strategies associated with the engine.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein.

Where technical features mentioned in any claim are followed by references signs, the reference signs have been included for the sole purpose of increasing the intelligibility of the claims and accordingly, neither the reference signs nor their absence have any limiting effect on the technical features as described above or on the scope of any claim elements.

One skilled in the art will realise the disclosure may be embodied in other specific forms without departing from the disclosure or essential characteristics thereof. The foregoing embodiments are therefore to be considered in all respects illustrative rather than limiting of the disclosure described herein. Scope of the invention is thus indicated by the appended claims, rather than the foregoing description, and all changes that come within the meaning and range of equivalence of the claims are therefore intended to be embraced therein.

The invention claimed is:

1. A cylinder head mount comprising:

a base portion for mounting to a cylinder head of an engine;

a bracket portion configured to receive and support an engine component;

a body portion interposed between the base portion and the bracket portion; and a web support connecting a web flange to the body portion, wherein the web support comprises web arms connected to positions on the body portion adjacent ends of the bracket portion.

2. The cylinder head mount according to claim 1, wherein the engine component is selected from the group of an engine aftertreatment device, a turbocharger, an exhaust gas recirculation cooler, an oil cooler, an air filter, an electronic control module, an oil filter, and a muffler.

3. The cylinder head mount according to claim 1 wherein the web arms are angularly spaced and mutually diverge from the web flange.

4. The cylinder head mount according to claim 1 wherein a plurality of base flanges having through holes are positioned adjacent an outer perimeter edge of the base portion.

5. The cylinder head mount according to claim 4 wherein the base portion is mountable to the cylinder head through a valve cover.

6. The cylinder head mount according to claim 5 wherein the positions of the base flanges are aligned to the bolt hole positions of the valve cover.

7. The cylinder head mount according to claim 4 wherein the number and distribution of the base flanges provide for stable mounting of the cylinder head mount.

8. The cylinder head mount according to claim 1, wherein the bracket portion has a first and a second support member for supportive contact with the engine component.

9. The cylinder head mount according to claim 8 wherein the first and the second support members have a geometry corresponding to a geometry of the engine component.

10. The cylinder head mount according to claim 8 wherein the bracket portion comprises fastener straps for fastening the engine component.

11. The cylinder head mount according to claim 10 wherein the fastener straps are hingedly connected to the bracket portion.

12. A tractor comprising;

an engine; and a cylinder head mount, the cylinder head mount including:

a base portion for mounting to a cylinder head of an engine;

a bracket portion configured to receive and support an engine component;

a body portion interposed between the base portion and the bracket portion; and a web support connecting a web flange to the body portion, wherein the web support includes web arms connected to positions on the body portion adjacent ends of the bracket portion.

13. The tractor of claim 12, wherein the cylinder head mount includes a plurality of base flanges having through holes positioned adjacent an outer perimeter edge of the base portion.

14. The tractor of claim 12, wherein the bracket portion has a first and a second support member for supportive contact with the engine component.

15. A genset comprising:

an engine;

a generator; and a cylinder head mount, the cylinder head mount including:

a base portion configured to receive and support an engine component;

a bracket portion configured to receive and support an engine component;

a body portion interposed between the base portion and the bracket portion;

a plurality of base flanges having through holes positioned adjacent an outer perimeter edge of the base portion;

the bracket portion having a first and a second support member for supportive contact with the engine component;

a web support connecting a web flange to the body portion; and the web support including web arms connected to positions on the body portion adjacent ends of the bracket portion.

* * * * *